US005413013A

United States Patent [19]

Zambo

[11] Patent Number: 5,413,013

[45] Date of Patent: May 9, 1995

[54] TIE ROD ASSEMBLY FOR SAND MOLDING MACHINE

[75] Inventor: George Zambo, Avon Lake, Ohio

[73] Assignee: HACA Spare Parts Technology Inc., Westlake, Ohio

[21] Appl. No.: 35,286

[22] Filed: Mar. 22, 1993

[51] Int. Cl.[6] ..... G05G 1/00

[52] U.S. Cl. ..... 74/587; 74/579 R; 29/510; 29/517; 403/204

[58] Field of Search ..... 79/579 R, 587, 579 E, 79/582; 29/510, 517; 403/204

[56] References Cited

U.S. PATENT DOCUMENTS

| | | | |
|---|---|---|---|
| 1,182,777 | 5/1916 | Lavoo | 74/587 |
| 2,544,212 | 3/1951 | Bayless et al. | 74/587 |
| 2,825,241 | 3/1958 | Ferris | 74/587 X |
| 3,131,785 | 5/1964 | Blank | 74/587 X |
| 3,777,592 | 12/1973 | Ito | 74/587 X |
| 4,221,549 | 9/1980 | Rizzone et al. | 74/579 R |
| 4,419,804 | 12/1983 | Axthammer | 74/579 R X |
| 4,736,646 | 4/1988 | Bertling et al. | 74/582 |
| 4,901,426 | 2/1990 | Laue | 29/510 |
| 5,070,743 | 12/1991 | Simon | 74/579 E X |

FOREIGN PATENT DOCUMENTS

| | | | |
|---|---|---|---|
| 4011532 | 10/1991 | Germany | 74/587 |

*Primary Examiner*—Vinh T. Luong
*Attorney, Agent, or Firm*—George J. Coghill

[57] ABSTRACT

A sand molding machine comprises an elongated tie rod with a removable bearing sleeve portion at its distal end. The distal end of the rod where the sleeve is attached has a reduced diameter end spindle portion with multiple stepped support sections on its outer surface. The sleeve is of generally hollow cylindrical configuration and fits over the spindle end portion of the rod. The sleeve has an outward cylindrical bearing surface, and an inward surface with stepped support sections corresponding to and contacting the outside support sections on the rod when the sleeve is attached. The respective supporting sections on the rod and the sleeve provide a strong tight attachment of the sleeve to the rod without requiring excessive force in order to attach and/or remove the bearing from the rod.

20 Claims, 5 Drawing Sheets

TIE ROD ASSEMBLY FOR SAND MOLDING MACHINE

FIELD OF THE INVENTION

This invention relates generally to the field of sand molding machines, and relates more particularly to tie rods used in sand molding machines.

DESCRIPTION OF THE PRIOR ART

A flaskless, vertically parted sand mold making process is an operation that forms molds out of specially formulated "sand" in order to make an impression in the sand that can later be filled, with molten metal for example, to cast or mold a final desired part. The sand molds are partially formed in a "closed" molding chamber which is comprised of fixed and somewhat smooth top, bottom, and side walls, and movable forward and rear walls. The top wall has an opening in it to inject sand into the chamber. The rear wall has an impression cut or otherwise formed on it of a "forward" portion of the part to be molded, and the forward wall has an impression cut or otherwise formed on it of an opposed "rear" portion of the part to be molded. Sand is injected into the mold chamber with the front and rear walls in respective "closed" starting positions at the front and rear of the chamber area.

The rear wall is generally attached to a ram which can move the rear wall transversely through the inside of the chamber, so as to be able to push the molded sand in a forward direction out of the chamber after sand has been injected. The front wall of the chamber is generally made to be both transversely displaceable in a forward direction away from the chamber and molded sand after sand has been injected, and also "swingable" or laterally movable out of the way of the molded sand so that the molded sand can be pushed through and out of the chamber, and passed the front wall, by the movement of the rear wall. At the completion of a single mold forming cycle, when the molded sand has been pushed out of the chamber area, the rear wall is retracted to its closed starting position forming the rear wall of the sand forming chamber and the forward wall is moved back and retracted to its closed starting position forming the front wall of the chamber, and the cycle is ready to be repeated. The front and rear walls are cycled in this manner on a substantially continuous basis as should be known to those persons of ordinary skill in the sand molding art.

The transverse movement of the front wall, is generally accomplished by means of four long, massive, and somewhat expensive tie rods. Each of the tie rods are made to have an outward bearing wear surface. They are typically supported by and transversely move in three bushings located at three distributed positions along the rod, including one at at a forward distal end portion thereof. As is typical of all surfaces that rub against other surfaces in operation, the outer surfaces on the tie rods eventually tend to degrade and wear out with repeated use. However, because of the particular forces involved in this machine (typically the swinging action of the front wall of the chamber), the rods have a tendency to wear out considerably faster at the forward distal end bushing locations than at the other two bushing locations.

SUMMARY OF THE INVENTION

The present invention relates to improvements for sand molding machines and improvements to tie rods which may be used in such sand molding machines.

The invention comprises a removable sleeve for the end of a rod. In a preferred embodiment of the invention, the rod comprises a tie rod for sand molding machines as described above wherein the tie rod moves transversely in one or more bushings. More specifically, in this embodiment, it comprises a removable bearing sleeve member means to be attached to the end of a main tie rod member so that the bearing surface at the distal end of the main tie rod member can be easily changed without replacing the entire tie rod. The sleeve means is to be attached to a spindle end portion of the main tie rod member. The bearing sleeve member means comprises multiple cylindrical, radially inward, support surfaces means, including at least a distal cylindrical inward sleeve support surface means having a first cylindrical inside sleeve diameter, and a proximal cylindrical inward sleeve support surface means having a second cylindrical inside sleeve diameter greater than the first inside sleeve diameter. The distal support surface means on the sleeve is to be in supporting surface contact with a distal support surface on the spindle, and the proximal support surface means on the sleeve is to be in supporting surface contact with a proximal support surface on the spindle. In certain aspects of the invention, the first inside diameter of the sleeve can be dimensioned with respect to the first outside diameter of the spindle such that the distal support surface means of the sleeve and the distal support surface of the spindle are to be in tighter surface contact than the proximal support surface means of the sleeve and the proximal support surface of the spindle. In other aspects of the invention, the main tie rod member and the sleeve have a third support surface located transversely between the distal and proximal support surfaces, and dimensioned such that the surface contact between these respective intermediate support surfaces is tighter than the contact between the respective proximal support surfaces, but not as tight as between the respective distal support surfaces. Other inventive aspects are also disclosed.

The invention can obviate or reduce the need to replace a whole tie rod when only the forward portion of it needs to be replaced or repaired, but does so in a way that can also obviate or reduce the need for special tools and equipment, and/or the time and manpower required for the replacement process. The invention allows the end of a rod to be replaced at an efficient cost, without specialized tools, and without requiring substantial force or intricate structural configurations to hold the end of the rod in place, while still providing a good tight structural fit.

Thus, it is an object of certain aspects of the invention to provide a tie rod that is cost efficient, but yet will have the structural integrity required to perform adequately in operation.

BRIEF DESCRIPTION OF THE DRAWINGS

The invention can be more fully understood by reference to the following Description in conjunction with the Drawing Figures in which.

DESCRIPTION OF PREFERRED EMBODIMENT

Figure 5:
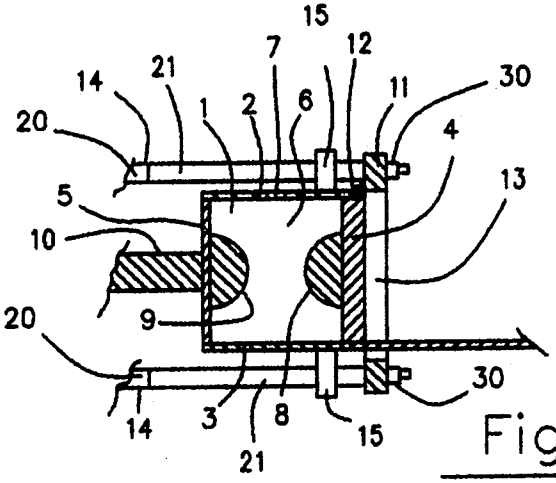
FIG. 5 is a cross sectional, somewhat schematic view of a sand molding machine with a forward wall in a retracted position ready for sand injection.
Figure 6:
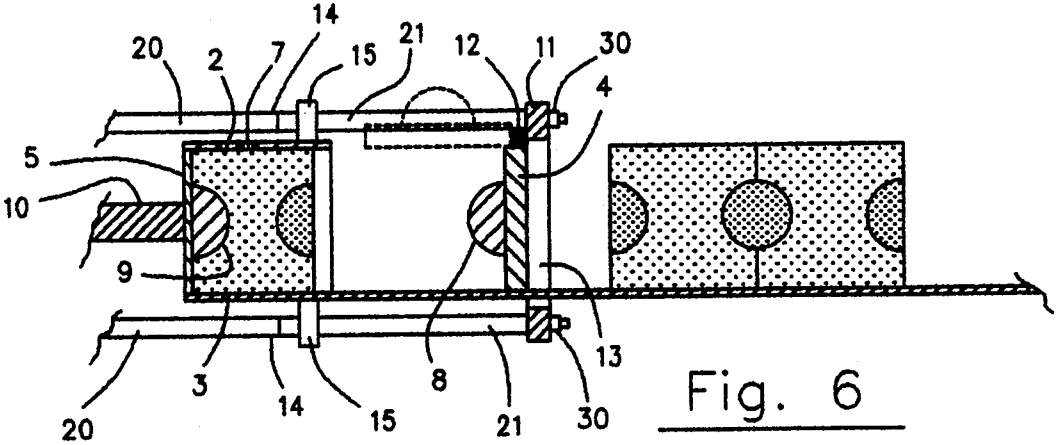
FIG. 6 is a cross sectional, somewhat schematic view of the sand molding machine of FIG. 5, with its forward wall in an extended position after sand injection.

Referring first to FIGS. 5 and 6, a typical sand molding machine which may comprise the invention can be described. It is believed that those of ordinary skill in the sand molding art are well familiar with such machines, and therefore the machine will be described in only general terms herein.

FIG. 5 depicts a cross sectional, somewhat schematic view of a flaskless vertically parted sand mold making machine. The machine comprises two stationary side walls 1 (only one is visible as viewed), a stationary top wall 2, a stationary bottom wall or base 3, a movable front wall 4, and a movable rear wall 5. The front and rear walls 4 and 5 as viewed in FIG. 5 are in a starting position so as to form a sand molding chamber 6 therebetween. The top wall 2 has an opening 7 therethrough for the injection of molding sand during operation.

The front and rear walls 4 and 5 have impressions 8 and 9 respectively formed on them in order to create respective desired impressions in the sand during the molding operation. The front wall 4 has an impression 8 of a rearward portion of a desired molded part, and the rear wall 5 has an impression 9 of a forward portion of the desired molded part.

The rear wall 5 is attached to a ram 10 and is dimensioned to have a close fit to the side, top and bottom walls 1, 2 and 3, but is just small enough to be movable transversely through the chamber 6 by the ram 10 in order to push a mold out of the chamber 6. The front wall 4 is attached to a frame 11 by means of hinges 12 at upper positions. The hinges 12 allow the front wall 4 to be swung upward (by means not shown) during certain phases of the molding operation as will be described more fully hereinbelow. The frame 11 has a central opening 13 through it large enough for a partially completed sand mold from the chamber 6 to pass through during operation. The frame 11 is attached at four distributed corners to elongated movable tie rods 14 by means of bolts 30. The tie rods 14 extend from the rear of the molding machine and straddle it, so as to enable the frame 11 to be moved transversely by the tie rods 14 away from the chamber 6 at predetermined times during operation. The tie rods 14 are movably supported in bushings 15. There are typically three bushings supporting the tie rods 14 at distributed locations along the length of each of the rods 14, but only the forward bushings 15 are shown as viewed in FIG. 5. Also typical of such machines, the rods 14 may have a total length of 15 feet, but may only be required to move a maximum of 30 inches or so in operation.

In operation, the front and rear walls 4 and 5 are cycled repeatedly as is well known to those of ordinary skill in the sand molding art. A cycle is started with the front wall 4 located at the front of the chamber 6 and the rear wall 5 at the rear of the chamber 6 substantially closing the chamber 6 except for the sand inlet 7 in the top wall 2. With the front and rear walls 4 and 5 in such positions, sand is injected into the chamber 6. Because of the impressions on the front and rear walls 4 and 5, a rearward portion of the desired mold is formed in the sand by the front wall 4 and a forward portion of the desired mold is formed in the sand by the rear wall 5.

Referring now to FIG. 6, once the sand is injected into the chamber 6, a partially formed mold is completed. At this point the forward wall 4 and frame 11 are moved transversely forward by the tie rods 14 far enough away from the chamber 6 so that the forward wall 4 can be pivoted upward and out of the way as depicted by the phantom lines in FIG. 6. After the forward wall 4 is pivoted upward, the rear wall 5 is then moved by the ram 10 transversely forward to push the partially formed mold a predetermined distance out of the chamber 6 and through the opening 13 in the frame 11. The operation is somewhat precisely controlled such that as successive partial sand molds are made, they are pushed forward just far enough to meet the previously made mold and form a succession of final molds of the part to be made, with each previous mold forming the forward impression of the part to be made, and each next mold forming the rear impression of the part to be made.

The structure of the tie rods 14 can be best seen by reference to FIGS. 1–4.

The tie rods 14 themselves comprise an elongated main rod 50 and a bearing sleeve member 53. The individual structures of these two members 50 and 53 can be best seen in drawing FIGS. 1 and 2.

Figure 1:
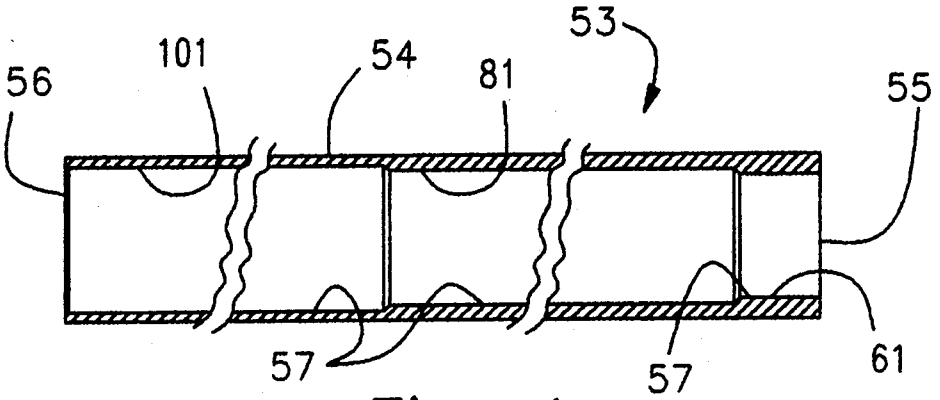
FIG. 1 is a cross-sectional view of a removable sleeve bearing for a tie rod rod according the the invention.
Figure 2:
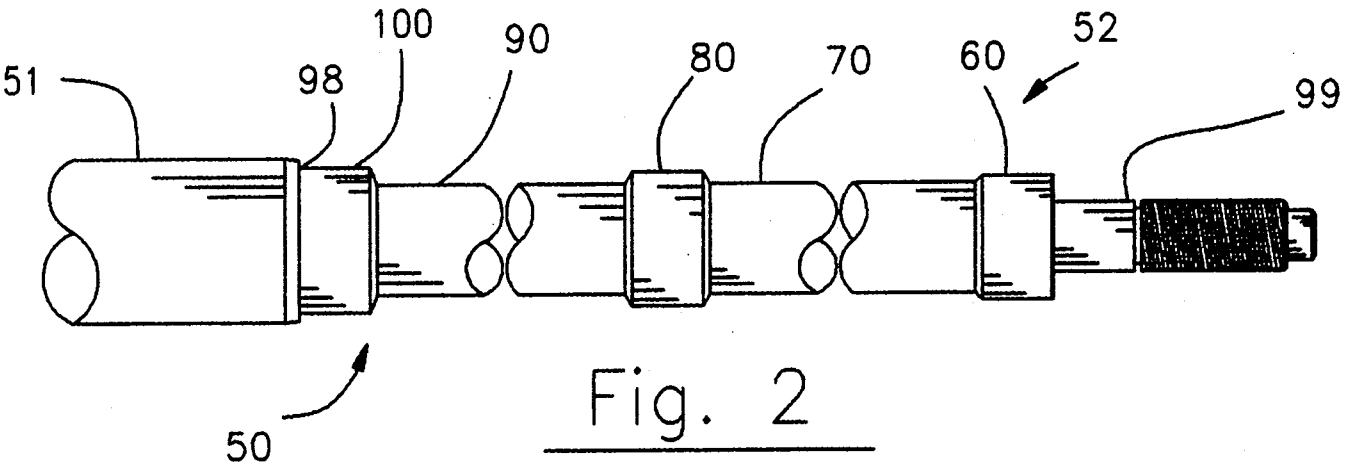
FIG. 2 is a side elevational view of the end of a tie rod adapted to receive the sleeve bearing of FIG. 1.

FIG. 1 shows a cross sectional view of the sleeve bearing 53 and FIG. 2 shows an elevational view of the end of the main rod 50, adapted to receive the sleeve bearing 53 of FIG. 1.

Referring first to FIG. 2, the main rod 50 has a cylindrical rear body portion 51 and a forward stepped distal end spindle portion 52 for attachment of the sleeve bearing 53. The distal end portion 52 of the main rod 50 has multiple, axially aligned, cylindrical, stepped outer or outward support surface sections 60, 80, and 100, separated along their axes by undercut portions 70 and 90. More specifically, the distal end portion 52 of the main rod 50 has a distal cylindrical outer support section 60, a proximal cylindrical outer support section 100, and an intermediate cylindrical outer support section 80 located transversely between the distal outer support section 60 and the proximal outer support section 101. A distal undercut portion 70 separates the distal outer support section 60 and the intermediate outer support section 80, and a proximal undercut portion separates the intermediate outer support section 80 and the proximal outer support section 100. The outer support sections 60, 80, and 100 have horizontally oriented cylindrical axes as viewed in FIG. 2, and have successively smaller diameters, proceeding from the proximal outer support section 100 to the distal outer support section 60. Thus: the distal outer support section 60 has the smallest diameter of the three cylindrical sections 60, 80, and 100; the intermediate outer support section 80 has a cylindrical diameter which is larger than the distal outer support section 60; and the proximal outer support section 80 has a cylindrical diameter which in turn is larger still than the intermediate outer support section 80.

Both of the undercut portions 70 and 90 can be made to have diameters smaller than the diameter of the smallest of the cylindrical support sections 60, 80, and 100, so as to avoid interfering contact during assembly as will be more fully described herein later. In addition to other benefits, the undercut portions 70 and 90 simplify the process of machining the end portion 52 of the rod 50. In some applications, it is desirable to machine and polish the support sections 60, 80, and 100 to somewhat close tolerances, and the undercut portions 70 and 90 help to define the exact area that needs to be brought into close tolerance without significant concern for the specific dimensions of the undercut portions 70 and 90 which are generally not critical.

The main rod 50 has a partially threaded, reduced diameter attaching shaft 99 at its most distal extreme, for attachment to the forward frame 11 of the sand molding machine by means of the bolt 30 (not shown in FIG. 2). The main rod 50 also has an annular stop face 98 located at the leftmost portion (as viewed in FIG. 1) of the proximal step 100 on the main rod 50.

In the particular application shown in FIGS. 1 and 2: the distal outer support section 60 can have a cylindrical diameter of 4.085 inches and an axial length (horizontal dimension as shown) of 2 inches (between the attaching shaft 99 and the distal undercut portion 70); the intermediate outer support section 80 can have a cylindrical diameter of 4.125 inches and an axial length (horizontal dimension as shown) of 2 inches (between the distal undercut portion 70 and the proximal undercut portion 90); and the proximal outer support section 100 can have a cylindrical diameter of 4.165 inches and an axial length (horizontal dimension as shown) of 2 inches (between the proximal undercut portion 90 and the rear body portion 51 of the main rod 50.)

Figure 3:
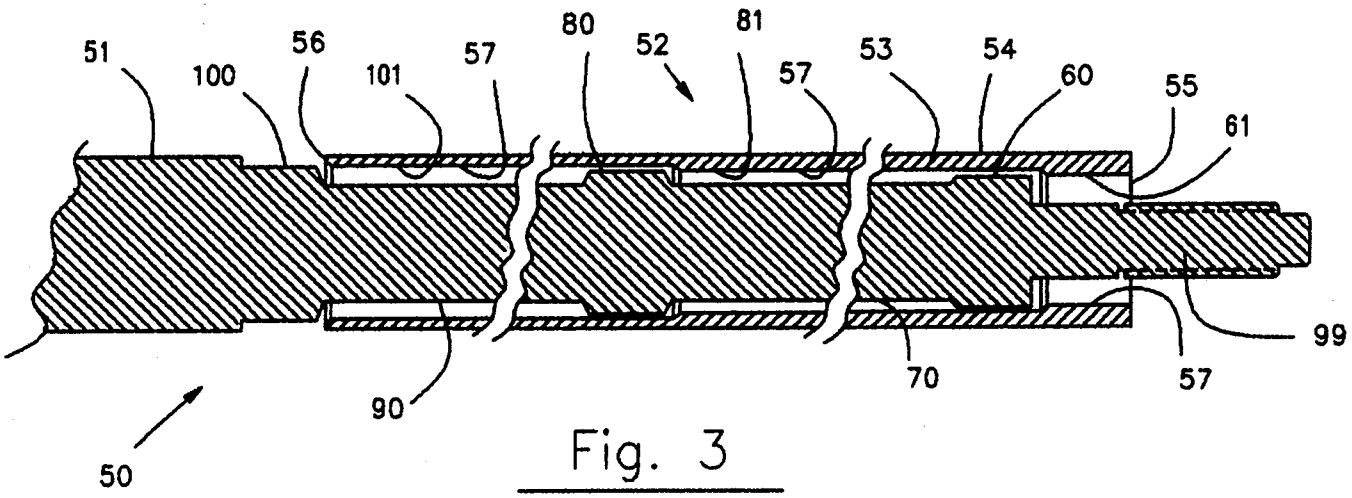
FIG. 3 is a cross sectional view of the sleeve bearing and tie rod of FIGS. 1 and 2 shown at an intermediate position during the attachment of the sleeve onto the end of the rod.
Figure 4:
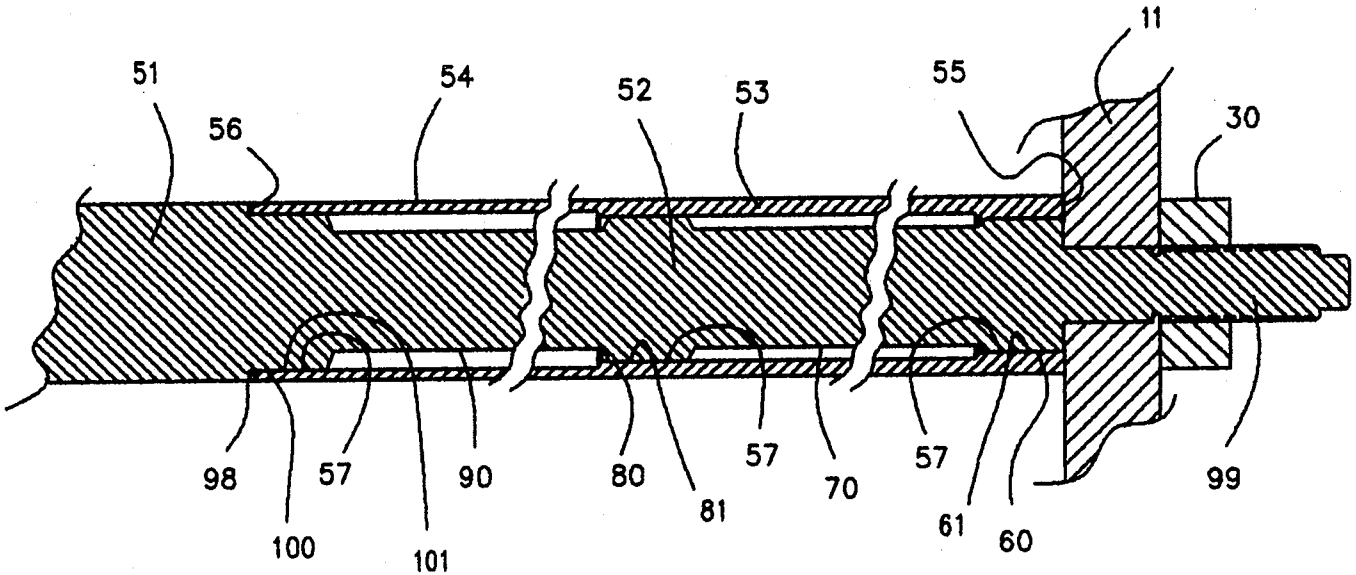
FIG. 4 is a cross-sectional view of the sleeve bearing of FIG. 1 fully attached to the rod of FIG. 2.

Referring now to FIGS. 1 and 4, the bearing 53 is made to fit over the forward distal end portion 52 of the main rod 50 and is generally of an elongated hollow cylindrical configuration, having a distal edge 55, a proximal edge 56, a smooth, cylindrical, radially outward bearing surface 54, and having a circumferential annularly stepped inside support surface 57. As can be seen with combined reference to FIGS. 1–4, the inside surface 57 of the bearing 53 is comprised of a distal, radially inward, annular sleeve support surface step 61, an intermediate, radially inward, annular sleeve support surface step 81, and a proximal, radially inward, annular sleeve support surface step 101. The distal inward sleeve support surface 61 has a first cylindrical inside sleeve diameter, the proximal inward sleeve support surface 81 has a second cylindrical inside sleeve diameter greater than the first sleeve diameter, and the intermediate inward sleeve support surface 101 is located transversely between the distal sleeve support surface 61 and the proximal sleeve support surface 101, and has a third cylindrical inside sleeve diameter greater than said first sleeve diameter, but smaller than said second sleeve diameter.

As can be seen best in FIG. 4, the axial dimensions of the sleeve 53 are made such that when the sleeve 53 is attached to the end portion 52 of the main rod 50, with the stop face 98 on the main rod 50 in contact with the proximal edge 56 of the sleeve 53, the inward distal support step 61 on the sleeve 53 axially overlaps and is in supporting surface contact with the outward distal support section 60 on the main rod 50, the inward intermediate support step 81 on the sleeve 53 axially overlaps and is in supporting surface contact with the outward intermediate support section 80 on the main rod 50, and the inward proximal support step 101 on the sleeve 53 overlaps and is in supporting surface contact with the outward proximal support section 100 on the main rod 50.

The respective inside diameters of the inward steps 61, 81, and 101 on the sleeve 53 can advantageously be selected to provide different individual "friction fits" between the different ones of the corresponding steps 60, 80, and 100 on the main rod 50. In a typical application for a sand casting machine, the fit between the distal steps 60 and 61 can be made to be tighter than the fit between the corresponding intermediate support surface steps 80 and 81 and the proximal support surface steps 100 and 101, and the fit between the intermediate steps 80 and 81 can in turn be made to be tighter than the fit between the proximal steps 100 and 101. Thus, the steps have a progressively increasing different friction fit between the various ones of the corresponding steps. For example, in the application described above for the sand casting process machine with the radial dimensions of the main rod 50 as noted above: the inside diameter of the distal inward step 61 on the bearing 53 can be made to be 4.086 inches; the inside diameter of the intermediate inward step 81 on the bearing 53 can be made to be 4.128 inches; and the proximal inward step 101 on the bearing 53 can be made to be 4.173 inches.

It is noted that in this embodiment of the invention, the overlapping support sections do not have an "interference fit". That is, the first outside diameter of the spindle end portion 52 of the main tie rod 50 is actually less than the first inside diameter of the sleeve 53, the second outside diameter of the spindle end portion 52 of the main tie rod 50 is actually less than the second inside diameter of the sleeve 53, and the third outside diameter of the spindle end portion 52 of the main tie rod 50 is actually less than the third inside diameter of the sleeve 53. Because of normal tolerence imperfections in the machining process, the "fit" is tight enough in this and many other applications with the relative dimensions given, while allowing the sleeve 53 to be attached to and removed from the rod 50 without the need for excessive force to do so. In other applications, depending on the requirements of the application, the friction fits may be all made the same, while still in other applications the fit may be made to be actual "interference" fits, without departing from various inventive aspects of the assembly.

FIG. 3 shows the rod 50 and bearing 53 in an intermediate stage during attachment of the sleeve 53 to the end of the main rod 50, and FIG. 4 shows the main rod 50 and sleeve 53 after complete attachment of the sleeve 53 to the end 52 of the main rod 50. As can be best observed in FIG. 4, when the sleeve 53 is completely assembled to the main rod 50 the respective outward steps 60, 80, and 100 of the main rod 50 are in general axially overlapping alignment with their respective corresponding inward steps 61, 81, and 101 respectively on the inside surface 57 of the sleeve 53. However, as can be best observed in FIG. 3, because of the successively reduced diameters of the outward support steps 100, 80, and 60 on the main rod 50 and the successively reduced diameters of the inward steps 61, 81, and 101 on the sleeve 53, the sleeve 53 fits only loosely over the end portion 52 of the main rod 50 until the rightmost edge (as viewed in FIGS. 1–4) of the outward support sections 60, 80 and 100 on the main rod 50 initially engage the leftmost portions (as viewed in FIG. 1–4) of their respective corresponding inward steps 61, 81, and 101 on the sleeve 53. The first spindle outside diameter is less than the second and third inside sleeve diameters by an amount sufficient to allow the proximal and intermediate support surfaces 101 and 81 of the sleeve 53 to pass over the distal support surface 60 on the end portion 52 of the main rod 50 without significant frictional resistance or interference, and the third spindle outside diameter is less than second inside sleeve diameter by an amount sufficient to allow the proximal support surface 101 of the sleeve 53 to pass over the intermediate support surface 80 on the end portion 52 of the main rod 50 without significant frictional resistance or interference. Thus, the sleeve 53 fits only loosely over the end portion 52 of the main rod 50 except for the actual axial dimension of the supporting steps 60, 80, and 100, on the main rod 50, e.g., in this case the last two inches of the assembly, and therefore only the last two inches need be "pressed" onto the main rod 50. This arrangement provides the stability of a long support of the bearing sleeve 53 on the rod 50 while reducing the actual surface area which the bearing sleeve 53 must be "pressed" over during assembly. Thus, when assembling the bearing 53 onto the end of the rod 50, it is only the individual corresponding overlapping surfaces of the stepped sections 60, 61, 80, 81, 100, 101 that must be "pressed" passed each other, reducing the required displacement end overall travel of the bearing sleeve 53 over the end of the main rod 50, and also reducing the force required to do so.

The outward surface of the main body portion 51 of the main rod 50 can typically be made to have a bearing surface having the same outward surface configuration and radial dimensions as the outward surface 54 of the bearing sleeve 53 and is typically circumferentially aligned therewith.

As noted above, in this application, the "friction fit" between overlapping steps is greatest between the distal steps 60 and 61, lesser between the intermediate steps 80 and 81, and the least between the proximal steps 100 and 101. This progressively diminished varying interference further reduces the force required to assemble the sleeve 53 onto the main rod 50, while providing the tightest fit at the very end of the rod 50 where it is desirable in this particular application.

It can be appreciated by those skilled in the art that the actual dimensions used for any particular bearing application of the invention will depend on many factors such as the length of the main body portion of the rod, the shape of the rod, the torques and other forces that the bearing will be subjected to during use, and other factors. The structure described herein for a bearing application of the invention can have a great deal of variance depending on the application, without departing from the scope of the invention and the benefits to be derived by the use of the concepts involved.

Figure 7:
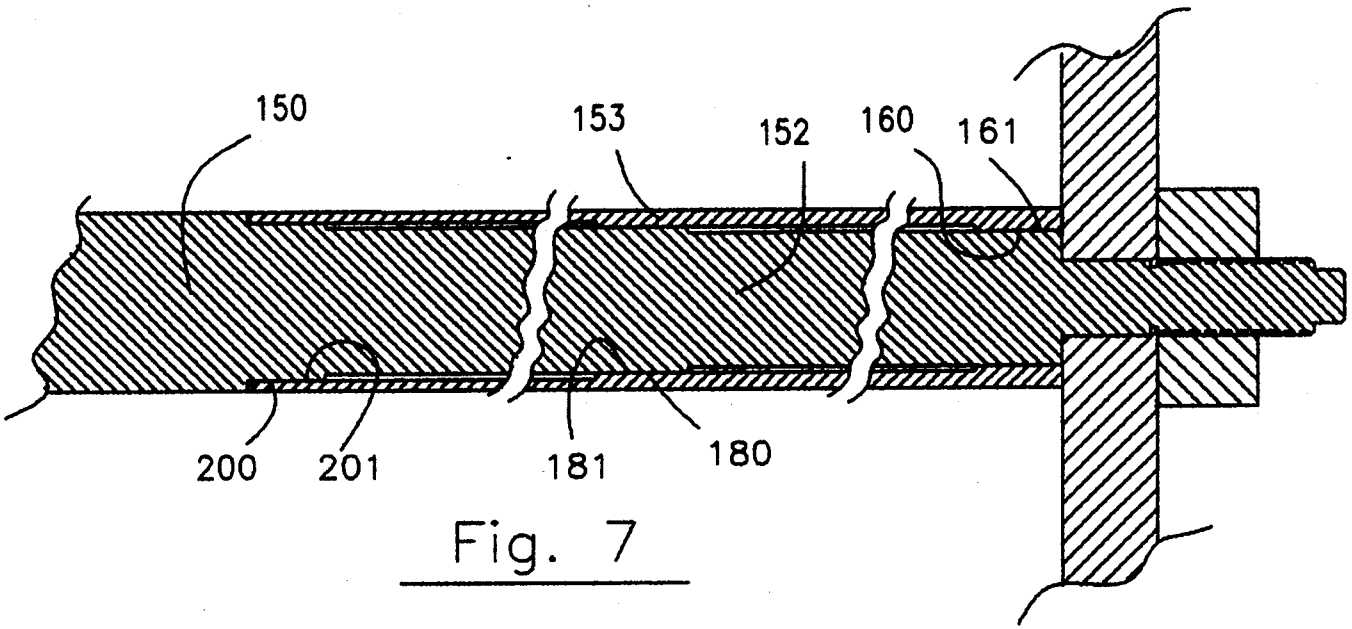
FIG. 7 is a cross sectional view of an alternative embodiment of tie rod assembly according to the invention.

FIG. 7 shows an alternative structure for a bearing assembly comprising a main rod 150 and a bearing sleeve 153 according to many aspects of the invention, substantially similar to the structure shown in FIGS. 1–4, but without the undercut portions on the outer surface of the rod 150.

The main rod 150 has a stepped spindle end portion 152 with three outward support surface steps 160, 180, and 200: namely a proximal outward cylindrical step 200, an intermediate outward cylindrical step 180, and a distal outward cylindrical step 160. The cylindrical radii of the stepped support surfaces 160, 180, and 200 are made to be successively smaller progressing from the proximal surface 200 to the distal surface 160.

The bearing sleeve 153 can be made identical to the bearing sleeve 53 of FIGS. 1–4, having an inward distal step surface 161, an intermediate step surface 181, and a proximal step surface 201.

The fundamental difference between the assembly of FIGS. 1–4 as opposed to the assembly of FIG. 7 is that the circumferential surface elevations of the undercut portions 70 and 90 in FIGS. 1–4 would be made to have the same radial elevation as an adjacent stepped support section, thus simply forming surface contact gaps between adjacent stepped support surfaces without necessarily undercutting the surface structure of the main rod 150. In other words, the undercut portion 70 of the main rod 50 in FIGS. 1–4 would be made to have the same radial dimension as the intermediate step 100 of the main rod 50, and the undercut portion 90 of the main rod 50 in FIGS. 1–4 would be made to have the same radial dimension as the intermediate step 100 of the rod 50. Thus, the respective relative axial dimensions of the stepped supporting surfaces 160, 180, 200, 161, 181, and 201 of the main rod 150 and bearing sleeve 153 are selected to provide a partial overlap between the corresponding supporting surfaces so that during attachment of the main rod 150 to, or removal of the main rod 150 from, the bearing 153, the net effect is similar as in the embodiment shown in FIGS. 1–4. That is, significant force is only required to slide the last two inches of the sleeve 153 onto the main rod 150. The amount of overlap of the supporting surfaces 160 with 161, 180 with 181, and 200 with 201 can be greater or less depending on various design criteria, which is believed to be within the ability of those having ordinary skill in the art to determine. In some applications the overlap might even be almost complete.

Similarly to the tie rod assembly depicted in FIGS. 1–4, the assembly of FIG. 7 can be made to have a successively tighter friction fit between successive ones of the corresponding inward and outward supporting surfaces or steps 160–161, 180–181, and 200–201, with the "fit" between the distal steps 160 and 161 being the tightest, and the "fit" between the proximal steps 200 and 201 being the "loosest".

It should be appreciated by those of ordinary skill in the art that many variations in the various inventive aspects disclosed will have application to other and diverse designs, parts, and uses not specifically described. For example, a bushing may be inserted into an opening using the inventive concepts disclosed, or there may be more than three support surface steps on the rod and bearing. It is expected that many applications for the invention will be developed and described by the following appended claims:

I claim:

1. A tie rod assembly for a sand molding machine comprising:

an elongated main tie rod member means for transverse operation in a support bushing and having a reduced diameter spindle end portion; and a bearing sleeve member on the spindle end portion of the main tie rod member;

wherein the bearing sleeve member comprises an outward bearing surface and having three cylindrical, radially inward, support surfaces, including a distal inward sleeve support surface having a first cylindrical inside sleeve diameter, a proximal inward sleeve support surface having a second cylindrical inside sleeve diameter greater than the first sleeve diameter, and an intermediate inward sleeve support surface, located transversely between the distal sleeve support surface and the proximal sleeve support surface, and having a third cylindrical inside sleeve diameter greater than said first sleeve diameter, but smaller than said second sleeve diameter;

and wherein the spindle end portion of the main tie rod member means has three cylindrical radially outward support surfaces, comprising at least a distal outward support surface having a first cylindrical outside spindle diameter, a proximal cylindrical support surface having a second cylindrical outside spindle diameter greater than the first spindle diameter, and an intermediate outward support surface located transversely between the distal spindle support surface and the proximal spindle support surface, and having a third cylindrical outside spindle diameter greater than said first spindle diameter, but smaller than said second spindle diameter;

and wherein said first spindle outside diameter is less than the second and third inside sleeve diameters by an amount sufficient to allow the proximal and intermediate support surfaces of the sleeve to pass loosely over the distal support surface on the spindle end portion; and wherein the third spindle outside diameter is less than second inside sleeve diameter by an amount sufficient to allow the proximal support surface of the sleeve to pass loosely over the intermediate support surface on the spindle end portion;

and wherein the distal support surface of the spindle end portion is in supporting surface contact with the distal support surface of the sleeve, the intermediate support surface of the spindle end portion is in supporting surface contact with the intermediate support surface of the sleeve; and the proximal support surface of the spindle end portion is in supporting surface contact with the proximal support surface of the sleeve.

2. The tie rod assembly of claim 1 wherein:

the main tie rod member means further comprises an outward bearing surface having the same radial outside dimensions as the outward bearing surface of the sleeve.

3. The tie rod assembly of claim 2 wherein the spindle end portion of the main tie rod member means further comprises an undercut section between successive support surfaces.

4. The tie rod assembly of claim 3 wherein the first outside diameter of the spindle end portion of the main tie rod member means is less than the first inside diameter of the sleeve, the second outside diameter of the spindle end portion of the main tie rod member means is less than the second inside diameter of the sleeve, and the third outside diameter of the spindle end portion of the main tie rod member means is less than the third inside diameter of the sleeve.

5. The tie rod assembly of claim 4 wherein:

the first inside diameter of the sleeve and the first outside diameter of the spindle end portion of the main tie rod member are dimensioned such that the distal support surface of the sleeve and the distal support surface of the spindle portion of the main tie rod member are in tighter surface contact than are the proximal support surface of the sleeve and the proximal support surface of the spindle end portion of the main tie rod member, and wherein the third inside diameter of the sleeve and the third outside diameter of the spindle end portion of the main tie rod member are dimensioned such that: the distal support surface of the sleeve and the distal support surface of the spindle end portion of the main tie rod member are in tighter surface contact than are the intermediate support surface of the sleeve and the intermediate support surface of the spindle end portion of the main tie rod member; and the intermediate support surface of the sleeve and the intermediate support surface of the spindle end portion of the main tie rod member are in tighter surface contact than are the proximal support surface of the sleeve and the proximal support surface of the spindle end portion of the main tie rod member.

6. The tie rod assembly of claim 5 wherein the first outside diameter of the spindle end portion of the main tie rod member means is less than the first inside diameter of the sleeve, the second outside diameter of the spindle end portion of the main tie rod member means is less than the second inside diameter of the sleeve, and the third outside diameter of the spindle end portion of the main tie rod member means is less than the third inside diameter of the sleeve.

7. A tie rod assembly comprising:

an elongated main tie rod member having a reduced diameter spindle end portion; and a bearing sleeve member friction fit onto the spindle end portion of the main tie rod member;

wherein the bearing sleeve member comprises multiple inward, support surfaces, including at least a distal inward sleeve support surface having a first sleeve inside diameter, and a proximal inward sleeve support surface having a second sleeve inside diameter greater than said first sleeve inside diameter;

and wherein the spindle end portion of the main tie rod member has multiple radially outward support surfaces, comprising at least a distal outward spindle support surface having a first outside diameter, and a proximal spindle support surface having a second spindle outside diameter;

and wherein the first spindle outside diameter is less than second sleeve inside diameter by an amount sufficient to allow the proximal support surface of the sleeve to pass loosely over the distal support surface on the spindle end portion of the main tie rod member;

and wherein the distal support surface on the spindle end portion of the main tie rod member is in friction fit supporting surface contact with the distal support surface on the sleeve, and the proximal support surface on the spindle end portion of the main tie rod member is in supporting surface contact with the proximal support surface of the sleeve;

and wherein the first and second spindle outside diameters and the first and second sleeve inside diameters have dimensions with respect to each other such that the distal support surfaces on the spindle end portion of the main tie rod member and on the sleeve are in tighter friction fit surface contact than are the proximal support surfaces on the spindle end portion of the main tie rod member and on the sleeve.

8. The tie rod assembly of claim 7 wherein:

there are three, radially inward, support surfaces on the bearing sleeve member including an intermediate inward sleeve support surface, located transversely between the distal sleeve support surface and the proximal sleeve support surface and having a third sleeve inside diameter greater than said first sleeve inside diameter, but smaller than said second sleeve inside diameter;

there are three, radially outward, support surfaces on the spindle end portion of the main tie rod member, including an intermediate outward sleeve support surface, located transversely between the distal spindle support surface and the proximal spindle support surface and having a third spindle outside diameter greater than said first spindle outside diameter, but smaller than said second spindle outside diameter;

the intermediate support surface on the sleeve is in supporting surface contact with the intermediate support surface on the spindle end portion of the main tie rod member;

and wherein the spindle end portion of the main tie rod member further comprises an undercut section between successive support surfaces.

9. The tie rod assembly of claim 8 wherein the support surfaces comprise cylindrical surfaces and wherein the bearing sleeve member comprises a cylindrical radially outward bearing surface.

10. The tie rod assembly of claim 9 wherein the the main tie rod member comprises an outward bearing surface comprising the same radial outside dimensions as the outward bearing surface of the sleeve member.

11. The tie rod assembly of claim 8 wherein the first outside diameter of the spindle end portion of the main tie rod member is less than the first inside diameter of the sleeve, the second outside diameter of the spindle end portion of the main tie rod member is less than the second inside diameter of the sleeve, and the third outside diameter of the spindle end portion of the main tie rod member is less than the third inside diameter of the sleeve.

12. The tie rod assembly of claim 8 wherein:

the support surfaces comprise cylindrical surfaces;

and wherein the first outside diameter of the spindle end portion of the main tie rod member means is less than the first inside diameter of the sleeve, the second outside diameter of the spindle end portion of the main tie rod member means is less than the second inside diameter of the sleeve, and the third outside diameter of the spindle end portion of the main tie rod member means is less than the third inside diameter of the sleeve.

13. The tie rod assembly of claim 12 wherein the bearing sleeve member comprises a cylindrical radially outward bearing surface; and wherein the main tie rod member comprises an outward bearing surface comprising the same radial outside dimensions as the outward bearing surface of the sleeve member.

14. A tie rod assembly for transverse movement in a bushing comprising:

a bearing sleeve member means which is to be attached to a spindle end portion of a main tie rod member;

wherein the bearing sleeve member means comprises multiple cylindrical, radially inward, support surfaces means, including at least a distal cylindrical inward sleeve support surface means having a first cylindrical sleeve inside diameter, and a proximal cylindrical inward sleeve support surface means having a second cylindrical sleeve inside diameter greater than the first sleeve inside diameter;

and wherein the distal support surface means on the sleeve is to be in supporting friction fit surface contact with a distal support surface on the spindle end portion of the main tie rod member, and the proximal support surface means on the sleeve is to be in supporting friction fit surface contact with a proximal support surface on the spindle end portion of the main tie rod member;

and wherein the first inside diameter of the sleeve is dimensioned with respect to the first outside diameter of the spindle end portion of the main tie rod member such that the distal support surface means of the sleeve and the distal support surface of the spindle portion of the main tie rod member are to be in tighter friction fit surface contact than the proximal support surface means of the sleeve and the proximal support surface of the spindle portion of the main tie rod member.

15. The tie rod assembly of claim 14 wherein:

there are three cylindrical, radially inward, support surfaces means on the bearing sleeve member means, including an intermediate cylindrical inward sleeve support surface means, located transversely between the distal sleeve support surface means and the proximal sleeve support surface means and having a third cylindrical inside sleeve diameter greater than said first inside sleeve diameter, but smaller than said second inside sleeve diameter;

and wherein the intermediate support surface means on the sleeve member means is to be in supporting surface contact with an intermediate support surface on the spindle end portion of the main tie rod member.

16. The tie rod assembly of claim 15 wherein:

the first inside diameter of the sleeve is dimensioned with respect to the first outside diameter of the spindle end portion of the main tie rod member such that the distal support surface means of the sleeve and the distal support surface of the spindle portion of the main tie rod member are to be in tighter surface contact than the proximal support surface means of the sleeve and the proximal support surface of the spindle portion of the main tie rod member;

and wherein the third inside diameter of the sleeve is dimensioned with respect to the third outside diameter of the spindle end portion of the main tie rod member such that: the distal support surface means of the sleeve and the distal support surface of the spindle end portion of the main tie rod member are in tighter surface contact than are the intermediate support surface means of the sleeve and the intermediate support surface of the spindle end portion of the main tie rod member; and the intermediate support surface means of the sleeve and the intermediate support surface of the spindle end portion of the main tie rod member are to be in tighter surface contact than the proximal support surface means of the sleeve and the proximal support surface of the spindle end portion of the main tie rod member.

17. The tie rod assembly of claim 15 wherein the first outside diameter of the spindle end portion of the main tie rod member means is less than the first inside diameter of the sleeve, the second outside diameter of the spindle end portion of the main tie rod member means is less than the second inside diameter of the sleeve, and the third outside diameter of the spindle end portion of the main tie rod member means is less than the third inside diameter of the sleeve.

18. The tie rod assembly of claim 17 wherein:

the first inside diameter of the sleeve is dimensioned with respect to the first outside diameter of the spindle end portion of the main tie rod member such that the distal support surface means of the sleeve and the distal support surface of the spindle portion of the main tie rod member are to be in tighter surface contact than the proximal support surface means of the sleeve and the proximal support surface of the spindle portion of the main tie rod member, and wherein the third inside diameter of the sleeve is dimensioned with respect to the third outside diameter of the spindle end portion of the main tie rod member such that: the distal support surface means of the sleeve and the distal support surface of the spindle end portion of the main tie rod member are in tighter surface contact than are the intermediate support surface means of the sleeve and the intermediate support surface of the spindle end portion of the main tie rod member; and the intermediate support surface means of the sleeve and the intermediate support surface of the spindle end portion of the main tie rod member are to be in tighter surface contact than the proximal support surface means of the sleeve and the proximal support surface of the spindle end portion of the main tie rod member.

19. The tie rod assembly of claim 18 wherein the bearing sleeve member means comprises a cylindrical radially outward bearing surface.

20. The tie rod assembly of claim 19 wherein the main tie rod member comprises an outward bearing surface comprising the same radial outside dimensions as the outward bearing surface of the sleeve member means.

* * * * *